United States Patent [19]

McKinney et al.

[11] 3,941,277

[45] Mar. 2, 1976

[54] EMBOSSED CAN END CONSTRUCTION

[75] Inventors: Lynn B. McKinney, Canton; Gary R. Ortiz, Massillon, both of Ohio

[73] Assignee: Van Dorn Company, Cleveland, Ohio

[22] Filed: Apr. 21, 1975

[21] Appl. No.: 570,245

[52] U.S. Cl. ..... 220/273; 220/90.6

[51] Int. Cl.[2] ..... B65D 41/32

[58] Field of Search ..... 220/270–273, 220/90.6

[56] References Cited

UNITED STATES PATENTS

| | | | |
|---|---|---|---|
| 3,752,353 | 8/1973 | Slade | 220/273 |
| 3,762,596 | 10/1973 | Henning et al. | 220/273 |
| 3,891,117 | 6/1975 | Dragomiter et al. | 220/270 |

*Primary Examiner*—George T. Hall
*Attorney, Agent, or Firm*—Frease & Bishop

[57] ABSTRACT

An embossed can end construction for full opening, easy opening metal cans used for food products that are heat-processed in the closed cans. The can end has an embossed formation in the removable panel of the can end defined by an endless generally annular score line, either with or without a protective fold at the peripheral edge of the removed panel. A ring pull tab is riveted to the removable panel portion having a nose with an offset tip which engages the can end adjacent the score line to initiate rupture of the can end at the score line when the ring of the tab is raised and the nose tip moves down. The embossed formation has a general modified heart-shape in contour with a depressed groove defining the heart-shape. The embossed formation imparts great stiffness to the can end metal. The stiffness maintains a planar shape for the can end which resists doming or bulging when the end is subjected to pressure inside the can different than atmospheric pressure. The planar stiffness imparted by the embossed formation assists in directing the initial rupturing force of the cooperating pull ring nose tip substantially vertically, that is parallel with the axis of the can and the axis of the riveted connection between the pull ring and can end. The stiffness also prevents curling of the removable panel as the panel is completely pulled away from the can by the final lifting of the pull ring from the can.

15 Claims, 17 Drawing Figures

EMBOSSED CAN END CONSTRUCTION

CROSS REFERENCE TO RELATED APPLICATION AND PATENTS

The can end and pull ring structures of the invention, either with or without protective folds, are improvements on the structures shown in copending McKernan and Stargell application Ser. No. 229,678 and Dragomier and Zysset application Ser. No. 473,009, now U.S. Pat. No. 3,891,117 and also those shown in Stargell U.S. Pat. Nos. 3,838,788 and 3,871,314.

BACKGROUND OF THE INVENTION

1. Field of the Invention

The invention relates to food product cans provided with can end members which may be opened easily by tearing with a ring pull tab, a full opening removable panel portion to which the tab is riveted, along an endless score line formed in the can end member, particularly a can end of a can used for food products that are heat-processed in the closed can; and more particularly, to providing stiffness to relatively thin sheet metal can end material in the removable panel portion, whether or not the removable panel portion is provided with a protective fold at the peripheral edge of the removed panel, so as to obtain maximum rupturing force in initiating, without tab rivet connection damage, rupture of the score line defining the removable panel portion when initially lifting the ring pull tab riveted to the panel portion, and also particularly to such a construction in which the apparent force required to remove the severed panel is less because of the stiffness of the embossed panel.

2. Description of the Prior Art

Many prior patents show various kinds and types of embossed formations in the can end of a can adapted to be opened by tearing the can end along one or more score lines to remove the can end, tear strip fashion, as in U.S. Pat. Nos. 2,112,231, 3,195,768, 3,221,923, and 3,416,699; or to remove the can end of a full opening can along a circumscribing score line as in U.S. Pat. Nos. 3,478,918, 3,712,503, 3,715,050, 3,735,892, and 3,768,692.

These prior can end structures contain embossed formations in the tear strip type of can end for directing the tearing properly along the score lines defining the tear strip. The prior structures in the case of full opening can ends in which a panel is removed by tearing along a continuous circumscribing score line have panel embossed formations to direct, control and implement the curling of the removed panel portion as it is being peeled from the can.

No can end structure of which we are aware has been provided with means such as an embossed formation in the can end for maintaining the can end stiff and in substantially a flat plane during the moment of initial application of rupturing force by the nose of a pull tab riveted to the removable panel portion to initiate rupture along the score line defining the removable portion, so that the rupturing force is applied to the can end adjacent the score line in as near to a vertical direction as possible so as to shear the metal on the score line, rather than to tear it.

Further, no prior structure of a full opening can end of which we are aware is provided with an embossed reinforcing formation in its removable panel, which provides full opening of the can, whether or not the removable panel has a protective formation at the edge thereof, in which the removable panel is maintained substantially stiff and flat or planar in extent, as the panel is pulled upward and removed by severing along the major portion of its periphery after an initial segment thereof has been bent inward of the can upon initiation of rupture by downward force applied by the nose of the pull tab riveted to the removable panel portion.

The use of easy opening cans in the heat-processed canned food industry has resulted in many problems concerning the construction and opening of such cans because of the tendency of the can end to dome or bulge outward or inward as a result of pressure or vacuum forces occurring in connection with heat-processing of the food in the cans. Such doming or bulging may affect the manner or direction in which force is applied by a ring pull tab to the can end material initially to rupture and later to pull the removable panel portion from the can along the score line defining the removable panel portion.

Some of these difficulties may be minimized by providing heavier gauge metal for the can ends and ring pull tabs. Such solution of the problems, however, is unsatisfactory, not only because of the cost of and use of additional metal, but also because it affects the ability to manufacture and handle the can ends and pull tabs in the production and manufacture thereof in existing tool and die means designed for lighter gauge metals.

Accordingly, there exists a need for overcoming the deficiencies in prior removable panel can end and pull tab structures without increasing metal thickness, and at the same time providing for applying maximum rupturing force and apparent minimum lifting force by the pull tab to the removable panel portion when a full opening, easy opening can is opened.

SUMMARY OF THE INVENTION

Objectives of the invention include providing a special location, contour, and geometry for embossed formations in the removable panel portion of a can end, and the cooperative relation of the embossed panel to a ring pull tab riveted to the embossed panel for rupturing the removable panel from the can end along an endless score line defining the removable panel to form a full opening for the can, whether or not the removable panel portion is provided with a protective fold in the peripheral edge of the removed panel, so as to apply maximum rupturing force substantially vertically by the pull tab nose tip against the can end to initiate shearing rupture of the score line when lifting the ring of the pull tab to bend a zone of the removable panel inward of the can at the moment that rupture is initiated, and so as to then complete the removal of the initially ruptured panel portion for complete severence from the can with apparent minimum pulling force imparted to the ring of the pull tab arising from the stiffness imparted by the embossed formation, which maintains the embossed portion of the removable panel substantially flat as the panel is pulled upward from the can by the pull tab. Other objectives of the invention include providing a construction which satisfies the above stated objectives without the necessity of increasing the gauge or thickness of the metal from which the can end or ring pull tab is formed; providing a construction satisfying such objectives in which the cooperative relation of the embossed panel and pull tab components inhibit failure of the riveted connection between the components; and providing a construction eliminating the described difficulties heretofore encountered, achieving the indicated objectives simply, efficiently and inexpensively, and solving existing problems and satisfying existing needs in the canned food products field.

These objectives and advantages are obtained by the full opening, easy opening metal can, can end and ring pull tab construction and cooperative arrangement, the general nature of which may be stated as including in metal, preferably aluminum can construction, a can end member having a removable panel portion defined by an endless main score line adapted upon removal of said panel portion to provide a full open end to a can to which the end member is seamed; a ring pull tab having a ring end and an offset nose tip at its other end having rivet connection intermediate its ends to the removable panel portion; the offset nose tip normally being located adjacent the main score line for initiating shear score line rupture upon pulling the ring end of the pull tab; an endless heart-shaped groove embossed downward in said removable panel portion symmetrical about a line passing through the center of the can end member, the center of the riveted connection, and the nose tip of the pull tab; and means controlling initial and final bending of flap areas of the removable panel portion into the can along spaced zones perpendicular to said line, respectively, outside and inside of the rivet connection relative to the center of the can end, and outside said heart-shaped embossed groove.

BRIEF DESCRIPTION OF THE DRAWINGS

Preferred embodiments of the improved embossed can end construction of the invention — illustrative of the best modes in which applicants have contemplated applying the principles — are set forth in the following description and shown in the drawings, and are particularly and distinctly pointed out and set forth in the appended claims.

Similar numerals refer to similar parts throughout the drawings.

DESCRIPTION OF THE PREFERRED EMBODIMENTS

First Embodiment

Figure 1:
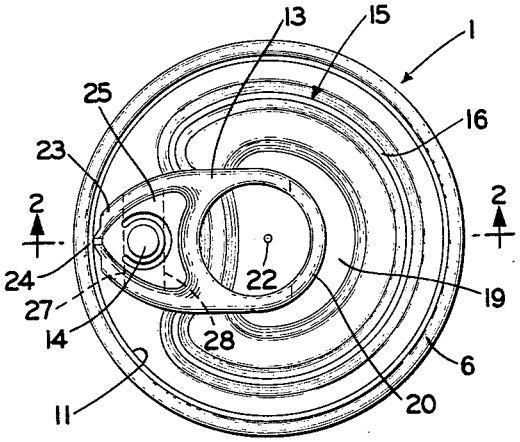
FIG. 1 is a top plan view of a can provided with one form of improved embossed can end construction.

The invention is illustrated typically in the drawings applied to a small sized can, although the can may be of any one of a number of sizes or capacities, or of any one of a number of types made by various manufacturers and which have a continuous score line in the can end member adjacent the double seam between the can body and can end member which defines the removable panel portion of the can end which is removed to provide the can with the full opening.

Figure 2:
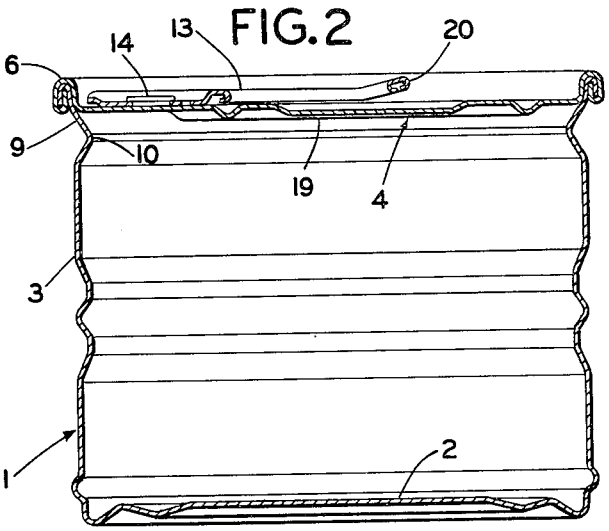
FIG. 2 is an enlarged vertical section taken on the line 2—2, FIG. 1.

The improved embossed can end construction illustrated in FIGS. 1 to 6 and 8 and 9, includes a can 1 generally of conventional construction which may be formed of aluminum, and has a cup-shaped body with a bottom wall 2 slightly recessed upwardly, and side walls 3 to which the embossed can end member generally indicated at 4 is connected through a seam flange 5 by a usual double seam, indicated at 6 in FIGS. 1 and 2 at the upper or open end of the can side walls 3. Can end member 4, in its stage before being seamed to the can 1 (FIGS. 3 and 4), has a recessed corner 7 at the lower end of the flange portion 8 which subsequently becomes a part of the double seam 6. The recessed corner 7 preferably is seated on a ledge or shoulder 9, formed by an inwardly projecting annular bead 10 located in the can side walls 3 below the double seam 6 (FIG. 2).

A curved score line 11 is formed in the end member 4 very close to the recessed corner 7. This score line 11 defines a panel portion generally indicated at 12 which is completely removable from the remainder of the end member 4, when torn, ruptured, or otherwise severed along score line 11 to provide a full opening at the top of the can 1.

A pull ring 13 is connected by a rivet 14 with the removable panel portion 12 and may have a construction modified from that shown in Henning Et Al U.S. Pat. No. 3,490,643. Pull ring 13 is formed of sheet metal, also preferably aluminum.

In accordance with the invention, an embossed formation generally indicated at 15 (FIGS. 3 and 4) is provided in the removable panel portion 12 of the can end 4. This embossed formation 15 comprises a downwardly formed embossment or groove 16 having a modified heart-shape, best illustrated in FIG. 3, and having lobes 17 in the heart-shaped contour at either side of a central concavity 18. The heart-shaped groove 16 is bounded outside and inside of the heart-shape by panel portions 12*a* and 12*b* which lie in the same plane at the top of the groove 16.

Figure 4:
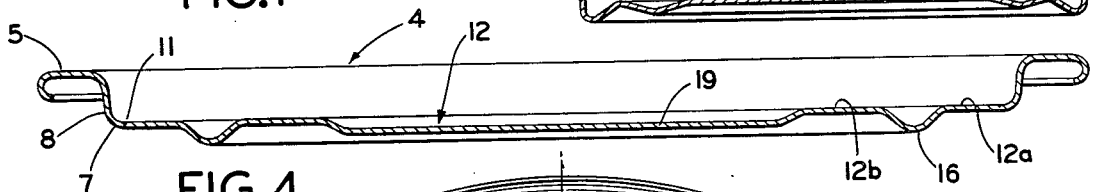
FIG. 4 is a section through the can end taken on the line 4—4, FIG. 3.

The panel portion 12 also is embossed centrally downwardly with a relieved finger-receiving area 19. This depressed area 19 is also generally heart-shaped, and the depth of the embossed portion 19 is less than the depth of the heart-shaped groove 16 (FIG. 4). In other words, the finger-receiving area 19 is offset vertically from the location of the bottom of the groove 16. The finger-receiving area 19 permits a finger or thumb to be inserted more readily under the ring end 20 of the pull tab 13 (FIG. 2).

The heart-shaped contours of groove 16 and finger-receiving area 19 are symmetrical about a radial line indicated by dot-dash line 21 passing through the center 22 of the can end 4, the center of the rivet 14, and the center of the nose 23 of tab 13. This radial line 21 shown in FIG. 3 also corresponds to the section line 2—2 of FIG. 1.

Figure 5:
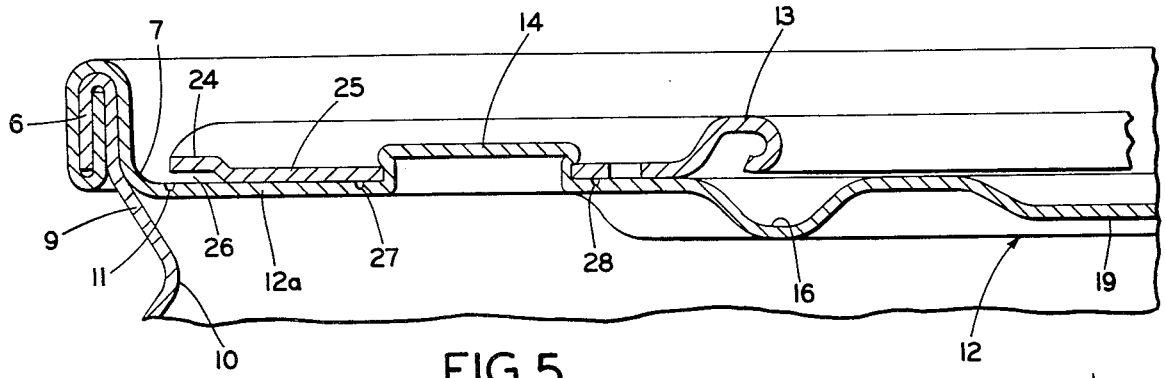
FIG. 5 is a greatly enlarged sectional view of the upper left-hand corner portion of FIG. 2 after the stage blank of FIGS. 3 and 4 has been seamed to the can of FIG. 2.

The V-shaped tip 24 of pull tab nose 23 is defined by a V formation and tip 24 is offset upwardly of the wall portion 25 of pull tab 13 engaged by the rivet 14 which provides the riveted connection between the pull tab 13 and removable panel portion 12 (FIG. 5). This offset nose tip 24 provides a slight clearance between the nose tip 24 and the flat zone 12*a* of the removable panel portion 12, such clearance being indicated at 26 in FIG. 5, the purpose of which is later described.

Figure 3:
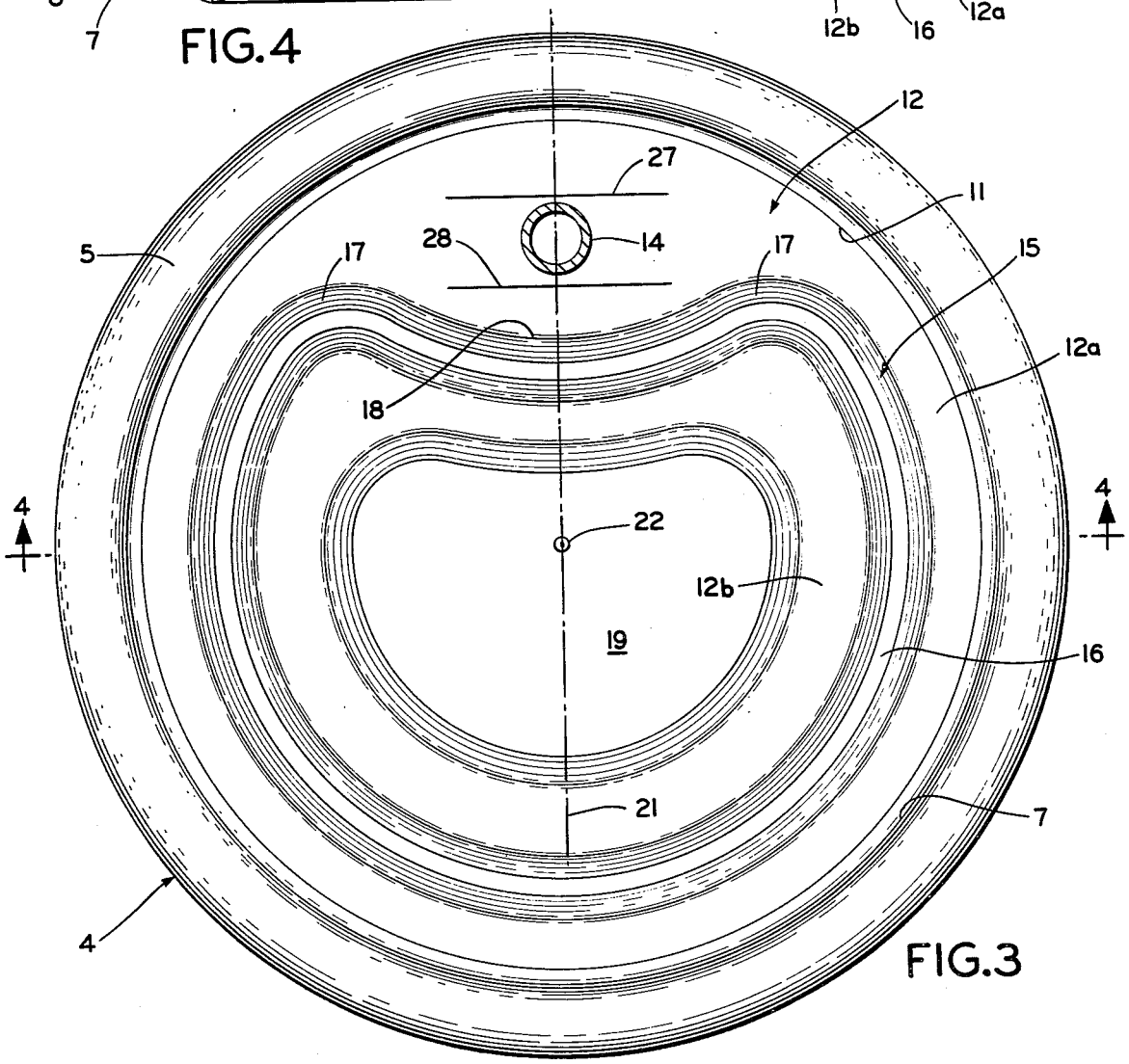
FIG. 3 is an enlarged top plan view of the can end shown in FIG. 1 in its stage prior to being seamed to the can as shown in FIG. 2, and with the ring pull tab removed.

An outer bend score line 27 is formed in the flat panel portion 12*a* outside of rivet 14, and an inner bend score line 28 also is formed in the flat panel portion 12*a* inside of rivet 14, as best shown in FIG. 3. Bend score lines 27 and 28 extend perpendicular to the radial line 21 passing through the can end center 22 and the center of rivet 14. Inner bend score line 28 also is aligned with the outer zones of the lobes 17 of heart-shaped groove 16, as well shown in FIG. 3.

Figure 8:
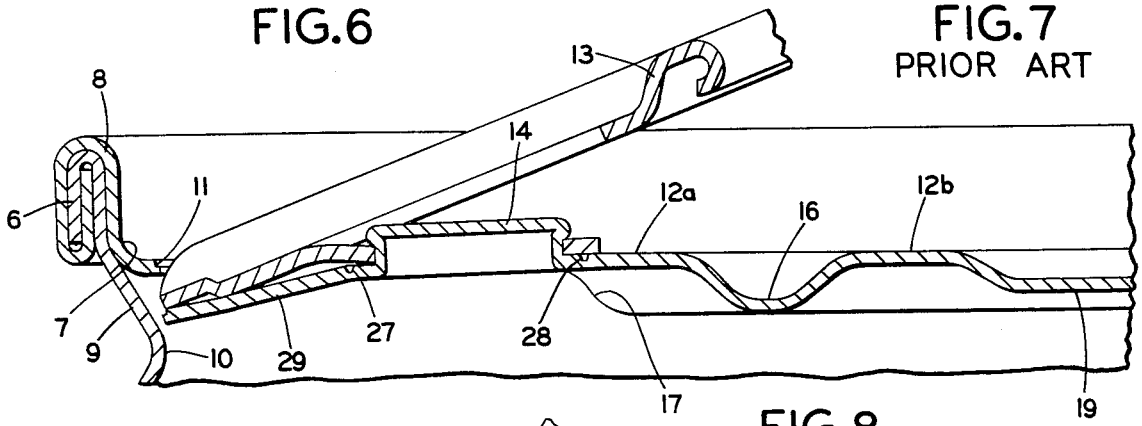
FIG. 8 is a view similar to FIGS. 5 and 6 illustrating further pull tab manipulation after shearing rupture of the can end material has been initiated by downward movement of the pull tab nose which bends into the can a small segment of the removable panel located outward of the riveted connection between the pull tab and can end.
Figure 9:
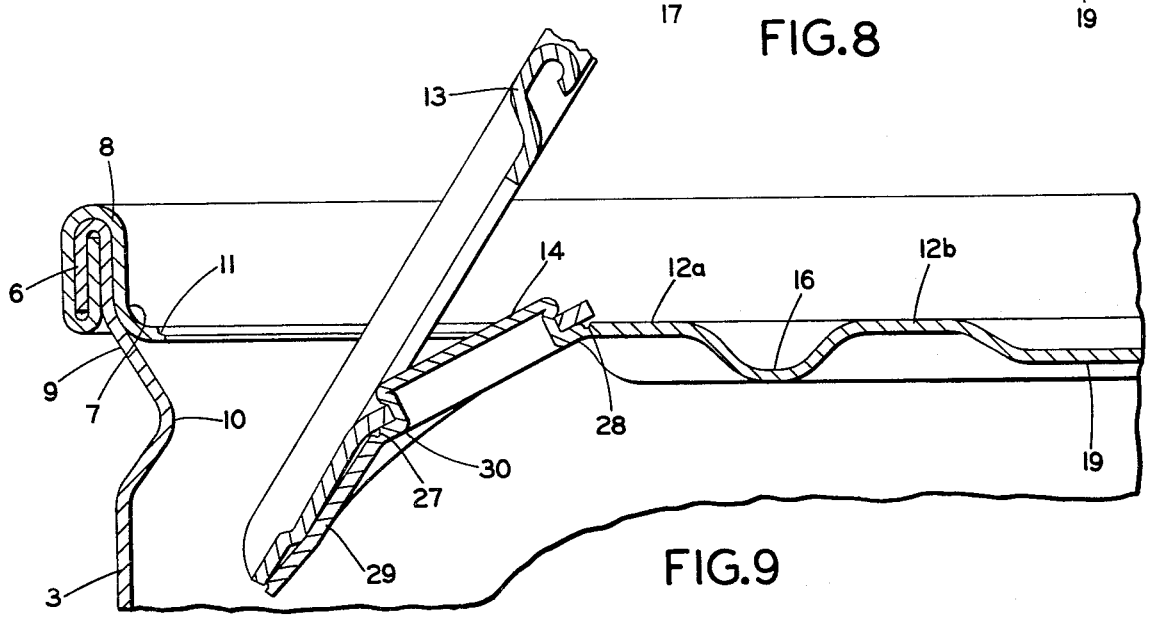
FIG. 9 is a view similar to FIGS. 5, 6 and 8 illustrating further manipulation of the pull tab to continue to bend another larger segment of the removable panel portion inward into the can, along a bend area located between the pull tab rivet connection and the center of the can end and located in a zone also controlled by lobes of the heart-shaped contour of the embossed formation in the can end.
Figure 10:
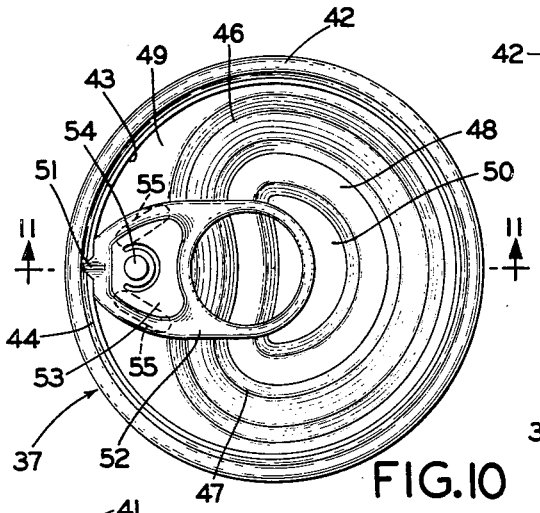
FIG. 10 is a view similar to FIG. 1 showing a modified form of embossed can end construction used when the peripheral edge of the removed panel portion is provided with a protective triple fold formation.
Figure 11:
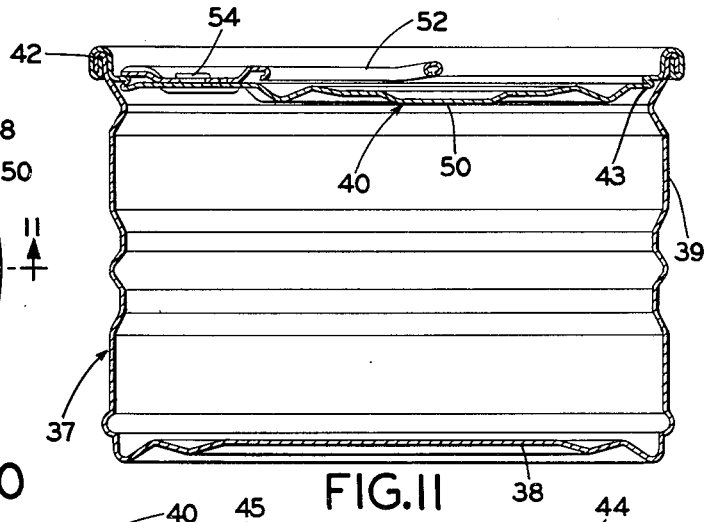
FIG. 11 is an enlarged vertical section taken on the line 11—11, FIG. 10.

Upon initially rupturing the can end metal at the score line 11, a small flap portion, indicated at 29, of the removable panel portion 12 is bent inward of the can 1 on the outer bend score line 27, as illustrated in FIG. 8. Further manipulation of pull tab 13 from the position of FIG. 8 to that of FIG. 9 increases the size of the portion bent inward of the can. This increased bending occurs on inner bend line 28, as shown in FIG. 9. The rivet 14 is located in the additional flap portion 30 which extends laterally on either side of the radial line 21 to the score line 11 and also extends between the outer and inner bend score lines 27 and 28.

Since the inner bend score line 28 is aligned with the lobes 17 of the heart-shaped groove 16, the shape of the embossed groove and its lobes 17 thus also control the location of the bending of the additional flap portion 30 beyond the ends of the inner bend score line 28 so that the bend extends chord-like between the intersection of the ends of the bend and the main score line 11, well illustrated by the position of components in FIG. 9.

There are a number of new advantageous results that arise from the embossed formations in the panel, their location, contour and geometry, the particular pull tab structure, and the cooperative relation or arrangement between the pull tab and embossed panel components.

One result of the embossed formations in the removable panel is that the embossment provides stiffness to the can end, despite the thin metal gauge thereof, so that when the pull tab 13 initially is lifted to begin the rupture operation, the area of the rivet 14 in the can end does not move appreciably vertically. This is indicated by comparing FIGS. 5 and 6.

Figure 6:
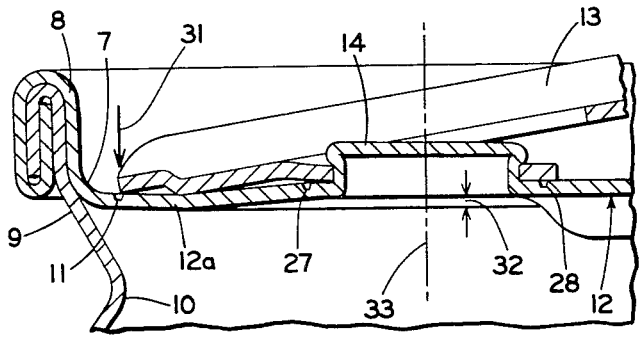
FIG. 6 is a fragmentary view similar to a portion of FIG. 5, showing the relative position of the can end and pull tab components after the ring end portion of the pull tab is pulled upward to initiate rupture of the can end along the score line defining the removable can end panel portion, but before any rupture has occurred.

In this manner, when lifting the tab from the position of FIG. 5 to that of FIG. 6 to initiate rupture of the score line, force is applied by the nose tip in as close to a vertical direction as possible, as indicated by the arrow 31 in FIG. 6. The stiffness imparted by the embossed formations maintains the removable panel portion 12 of the can end in a planar condition, and the stiff embossed panel portion moves only slightly vertically upwardly, illustrated by the slight clearance space 32 in FIG. 6, when pulling the tab 13. Also, the planar condition of the removable panel portion 12 of the can end maintains the axis 33 of the rivet 14 substantially vertical; and thus, the direction of the force applied by the nose tip of the pull tip 13, shown by arrow 31, is parallel with the rivet axis 33, and the axis of the can.

The offset or stepped character of the tip 24 of nose 23, indicated by the clearance 26 in FIG. 5, permits a finger or thumb to be inserted under the ring end 20 of pull tab 13 (FIG. 2) and thus the pull tab 13 may be moved initially to the position of FIG. 6 without much resistance. After such movement, the extreme end of the offset tip 24 contacts the flat zone 12*a* of the removable panel portion 12 just inside the main score line 11. Thus the force 31 for initiating rupture of the can end metal at the score line is applied downwardly as shown in FIG. 6, substantially vertically of or perpendicular to the can end wall, causing shearing of the can end metal at the score line. Shearing rupture of the metal thus is achieved with minimum force or effort required to be exerted by the user in lifting the pull tab 13.

Figure 7:
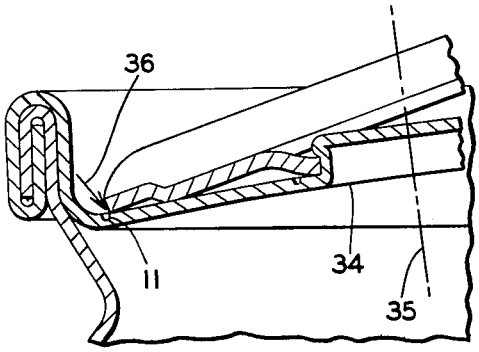
FIG.7 PRIOR ART
FIG. 7 is a view similar to FIG. 6 but showing the relation of similar components in prior art structures.

These results of the cooperative relation between or arrangement of the embossed can end and pull tab components, and their structure, may be compared with prior devices illustrated in FIG. 7 having a construction otherwise generally the same as in FIG. 6 but omitting the embossed formations.

In the absence of the embossed formations provided in accordance with the concept of the invention, the can end metal may bulge or dome upward, as indicated by the curved undersurface 34 of the can end in FIG. 7 when pulling the tab. The rivet center line 35 thus shifts to a non-vertical position, as shown in FIG. 7. The force applied by the tip of the pull tab nose, indicated by the arrow 36, is directed at quite an angle to the top surface of the thin end wall metal. This force 36 thus is directed to tearing-apart the metal at the score line 11, which may require much greater exertion of the user in proceeding to open the can, than with the arrangement shown in FIG. 6. In some cases, tab failure or failure of the rivet connection between the pull tab and can end wall may occur.

During initial rupture, the pull tab and end wall move from the position of FIG. 6 to that of FIG. 8, and an initial small flap portion 29, extending between the outer bend score line 27 and the main score line 11, is bent inward into the can 1, as illustrated in FIG. 8.

Continued manipulation of the pull tab 13 from the position of FIG. 8 to that of FIG. 9 ruptures the can end metal in arcuate zones extending beyond the ends of the initial rupture along the score line 11, and produces bending along the area of the inner bend score line 28 of a band comprising the additional flap portion 30.

The components, upon reaching the position shown in FIG. 9, with the rupturing of the can end metal along the main score line 11 extending on either side of the radial line 21 (FIG. 3) to the intersection of a projection of the inner bend score line 28 with the score line 11, then are completely torn apart throughout the entire extent of the main score line 11, upon continued pull of the tab 13.

During this stage of the tearing, the removable panel portion in which the embossed formation 15 is present, is maintained stiff and planar by the embossment; and the apparent force required to complete the removal of the panel is less than when stiffness is not maintained and the removable panel portion is permitted to curl, as illustrated in prior art referred to, such as in U.S. Pat. Nos. 3,490,643, 3,762,596 and 3,768,692.

These advantageous new results thus are achieved by the concept of the embossed can end and pull tab construction and combination without increasing metal thickness of either the can end or the pull tab in order to provide the stiffness achieved by the embossed formations 15 and 19 in the can end metal.

Second Embodiment

The improved embossed can end construction illustrated in FIGS. 10 through 17 is similar in all respects to that shown and described with reference to FIGS. 1 to 6, 8 and 9. The can end of FIGS. 10 through 17, however, includes the use of a peripheral protective triple fold formation throughout the peripheral edge of the removed panel portion.

Thus, the triple fold can generally indicated at 37 also has generally a conventional construction and may be formed of aluminum. The can 37 has a cup-shaped body with a bottom wall 38, and side walls 39 to which the embossed can end member generally indicated at 40 is connected through a seam flange 41 by usual double seam 42. The can end 40 in its stage before being seamed to the can 37 (FIGS. 12 and 13) is substantially the same as the stage can end member 4 in FIG. 4, except that a triple fold formation 43 is formed in the can end wall 40 inside the main score line 44, of the types illustrated, for example, in said copending applications Ser. Nos. 229,678 and 473,009 and also in U.S. Pat. Nos. 3,838,788 and 3,871,314.

The triple fold 43 which provides a protective edge on the removed panel portion, generally indicated at 45, imparts more resistance against initial rupture than is present in the can end shown in FIG. 4. Thus the can end 40 requires a greater degree of stiffness in order to achieve the advantages of the embossed can end construction of the invention.

Figure 13:
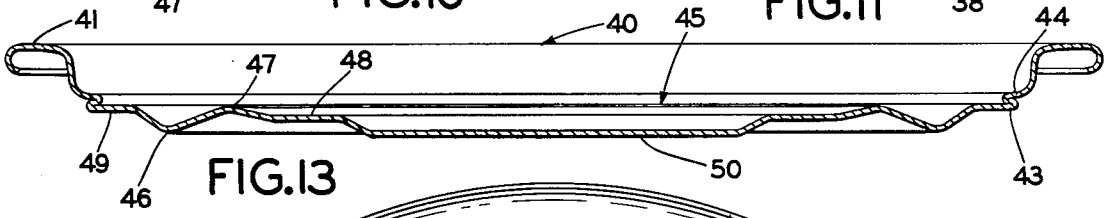
FIG. 13 is a section looking in the direction of the arrows 13—13, FIG. 12.
Figure 12:
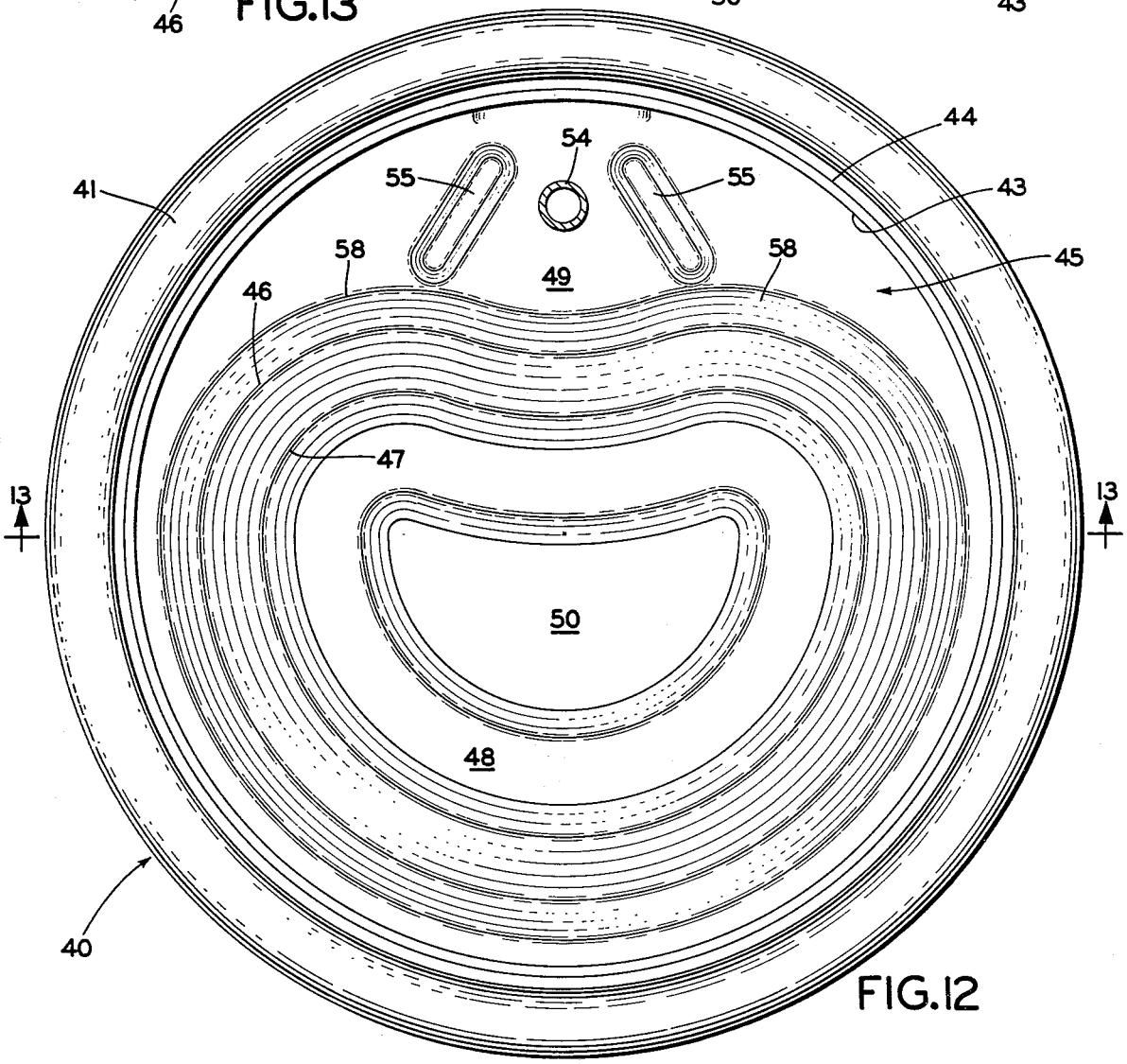
FIG. 12 is a further enlarged top plan view of the can end shown in FIG. 10 in its stage prior to being seamed to the can as shown in FIG. 11, with the ring pull tab removed.

This additional stiffness is provided by changing the shape or contour in section of the heart-shaped groove 46 so that it has greater width and depth than the heart-shaped groove 16, as illustrated in FIGS. 12 and 13. The embossed formation in can end 40 also includes a slight ridge 47 surrounding the interior of the heart-shaped groove 46 (FIG. 13).

The inner panel wall area 48 within the ridge 47 is depressed downwardly, though flat, and is parallel to the flat outer panel wall area 49 extending outside of and surrounding the heart-shaped groove 46. The central area of the removable panel portion 45 also is formed with a finger recess 50 whose flat recessed surface is offset below the depth of the heart-shaped groove 46.

Figure 14:
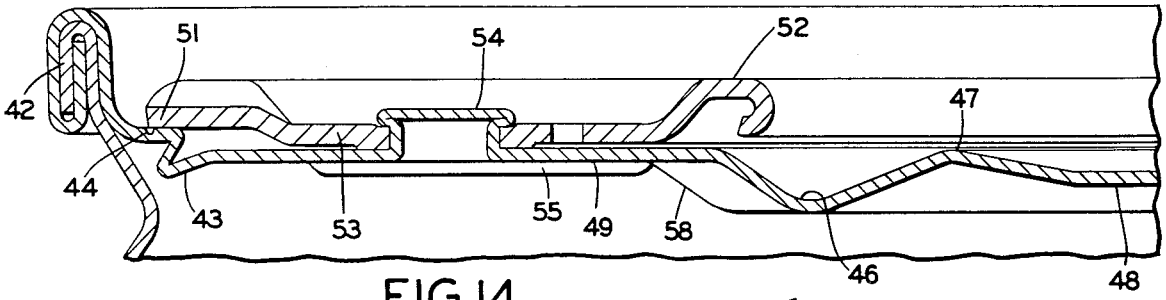
FIG. 14 is a greatly enlarged sectional view of the upper left-hand corner portion of FIG. 11 after the stage blank of FIG. 12 has been seamed to the can of FIG. 11.

The nose tip 51 of the pull tab 52 also is offset or stepped similar to the stepped portion 24 of pull tab 13, except that in the normal position of the components, best illustrated in FIG. 14, the stepped nose tip 51 lays along and contacts the upper layer of the triple fold 43. The stepped portion, however, of the tip 51 of the pull tab nose permits the remainder of the pull tab wall 53 to be engaged by the rivet 54 against the outer panel wall portion 49 which extends from the bottom layer of the triple fold 43 and is offset below the top layer of the triple fold. FIG. 14 illustrates that the zone of the triple fold immediately under the tip of the pull tab nose is open or relieved or has a fold clearance between the top and middle fold layers, as described in U.S. Pat. No. 3,871,314 and also as shown in U.S. Pat. No. 3,838,788.

Figure 15:
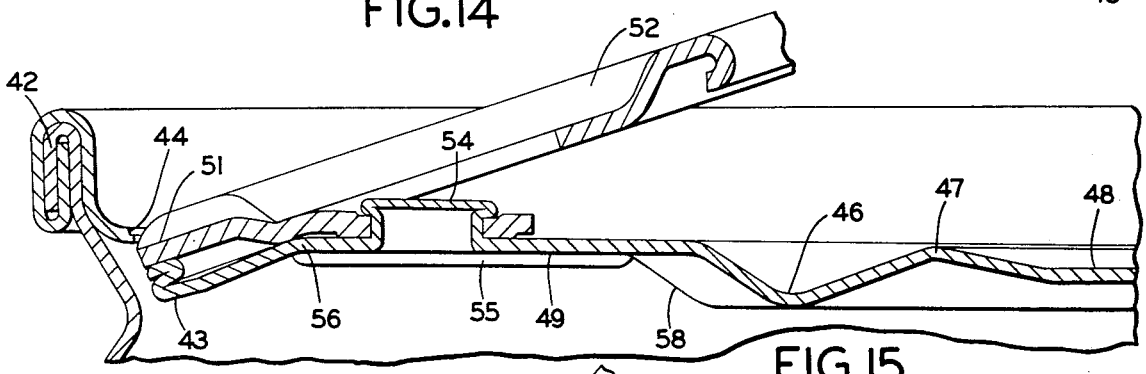
FIG. 15 is a view similar to FIG. 14 showing the components after shearing rupture at the score line defining the removable panel portion has occurred, by initial downward movement of the pull tab nose tip resulting from pulling the ring end of the pull tab upward.
Figure 16:
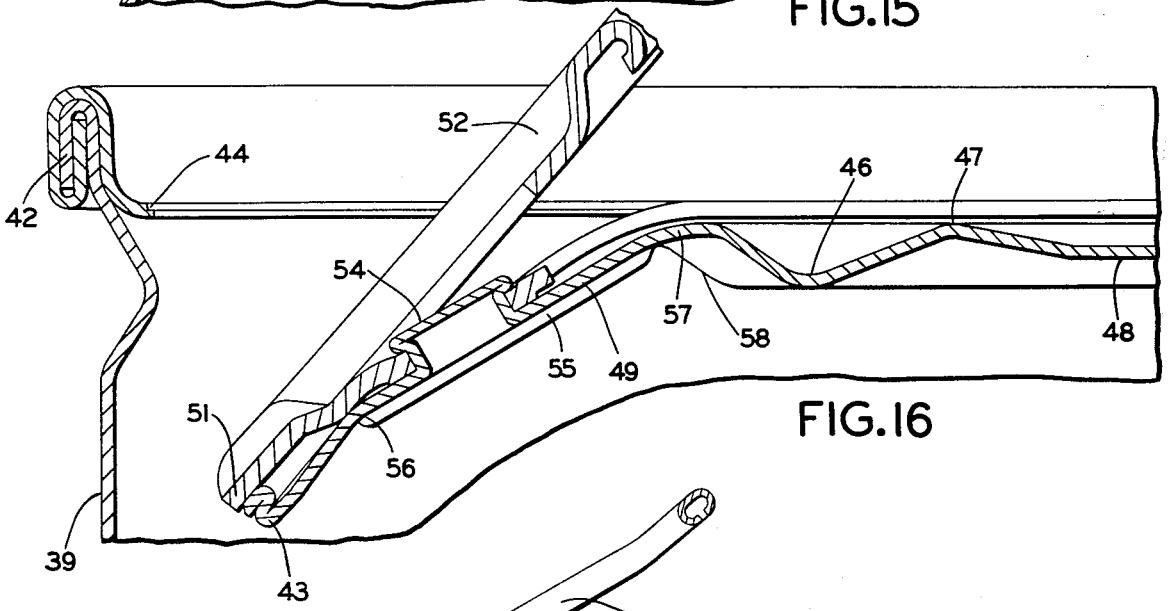
FIG. 16 is a view similar to FIG. 15 but showing further bending of the removable panel portion into the can at a zone defined by the lobes of the heart-shaped embossed formation in the removable panel portion.
Figure 17:
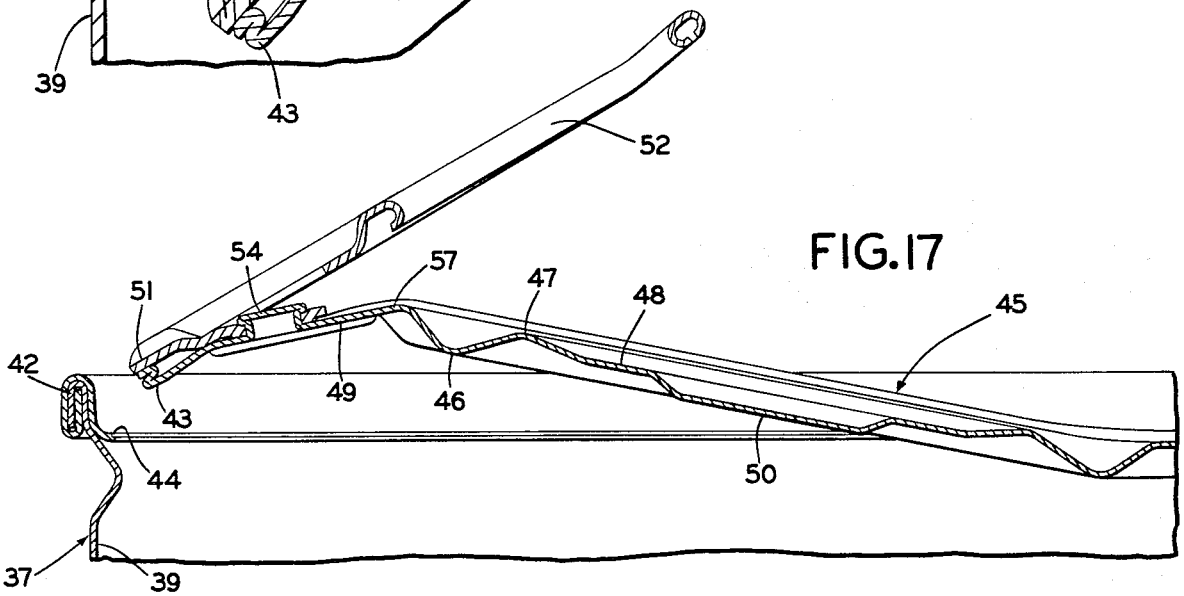
FIG. 17 illustrates a further stage in tearing the removable panel portion of the can end from the can, upon continuing upward pull of the pull tab from the can.

During the can opening operation, illustrated in FIGS. 15 to 17, the triple fold zone beneath the nose tip 51 of the pull tab 52 becomes compressed, as shown in FIGS. 15 and 16.

The embossed can end 40 is modified from the can end 4 in omitting the outer and inner bend score lines 27 and 28, present in the can end 4. Instead, the can end is formed, as shown in said copending application Ser. No. 473,009, with bend control beads 55 in the outer panel wall portion 49 on either side of the rivet 54 and beneath the pull tab 52. These control beads 55 define the spaced initial and final bend areas 56 and 57, as illustrated in FIGS. 15 and 16. The lobes 58 of the heart-shaped groove 46 also cooperate with the control beads 55 to define the final bend area 57 that develops on rupturing the removable panel portion 45 to open the triple fold can 37.

The manner in which the embossed can end 40 and its pull tab 52 in the triple fold can 37 function during the initial and final rupturing stages of opening the can is the same as described with respect to the embossed can end 4, except that the particular embossment formation of the can end 40 provides greater stiffness required for a triple fold can end.

FIG. 17 illustrates the manner in which the embossed portion of the removable panel maintains a generally planar condition without curling during the final stages of tearing the removable panel portion from the can 37.

This illustration of the stiff planar condition of the embossed portion of the removable panel portion in FIG. 17 also generally illustrates the same condition maintained in opening the can 1 of FIGS. 1 through 6, 8 and 9.

Accordingly, the improved embossed can end construction, exemplified in both embodiments of the invention described, overcomes deficiencies in prior removable panel can end and pull tab structures without increasing metal thickness, and at the same time provides maximum initial rupturing forces and apparent minimum lifting forces when a full opening, easy opening can is opened, either with or without a protective triple fold bead formation on the periphery of the removable panel portion; and thus, provides a construction achieving the indicated objectives simply, efficiently and inexpensively and solves existing problems and satisfies existing needs in the canned food products field.

In the foregoing description, certain terms have been used for brevity, clearness, and understanding; but no unnecessary limitations are to be implied therefrom beyond the requirements of the prior art because such terms are used for descriptive purposes and are intended to be broadly construed.

Moreover, the description and illustration of the invention in its several embodiments is by way of example, and the scope of the invention is not limited to the exact details shown or described, since the features of the invention may be applied to different sizes and types of cans.

Having now described the features, discoveries and principles of the invention, the manner in which the improved structures achieve the objectives, and the advantageous, new and useful results obtained; the new and useful structures, devices, elements, arrangements, parts, components, cooperative arrangements of components, combinations and subcombinations are set forth in the appended claims.

We claim:

1. Easy opening can end construction for a full opening can including a metal can end member having a seam flange and a recessed corner below the seam flange; an end member wall extending from said corner having a removable panel portion defined by an endless main score line located adjacent said corner; removal of said panel portion from said wall providing a full opening for a can to which the end member is seamed by said seam flange; a ring pull tab having a ring end and an offset nose tip at its other end; rivet means connecting the pull tab intermediate its ends to the panel portion; the nose tip normally being located adjacent the main score line for initiating shear score line rupture upon pulling the ring end of the pull tab away from said wall; an endless heart-shaped groove formation embossed downward in said panel portion symmetrical about a line passing through the center of the end member, the center of the rivet means, and the nose tip; and means controlling initial and final bending of adjacent flap areas of the removable panel portion into the can along spaced bend zones extending perpendicular to said line; said spaced bend zones being located, respectively, outside and inside the rivet means relative to the can end center, and said spaced bend zones both being located outside said embossed groove formation.

2. The construction defined in claim 1 in which the embossed formation imparts stiffness to the metal in said wall, and in which said stiffness maintains a planar shape for the embossed portion of the removable panel a. which assists in directing initial rupturing force applied by the nose tip vertically of the wall to rupture the wall and bend said flap areas into the can, and b. which prevents curling of the embossed panel portion as the panel portion is torn completely from the end member on said main score line.

3. The construction defined in claim 1 in which a heart-shaped finger-receiving recess is formed in said wall within and spaced from said groove, and in which the finger-receiving recess has a depth offset from the depth of the groove.

4. The construction defined in claim 1 in which the portion of the panel outside of and surrounding the endless groove extends in a flat plane, in which the pull tab has a wall portion engaged by said rivet means against the flat plane portion of said panel, and in which the offset nose tip is spaced above said flat plane portion of said panel.

5. The construction defined in claim 4 in which the panel portion has two flat areas, one surrounding the groove and the other surrounded by the groove.

6. The construction defined in claim 5 in which the two flat areas are in the same plane.

7. The construction defined in claim 5 in which the two flat areas lie in different planes.

8. The construction defined in claim 5 in which the panel portion is formed with a heart-shaped ridge connected with and surrounded by said groove.

9. The construction defined in claim 1 in which the embossed groove has spaced lobes adjacent the rivet means, in which the lobes are located one on either side of said line, and in which the spaced lobes assist in defining the bend zone inside the rivet means.

10. The construction defined in claim 1 in which spaced bend score lines are formed in the panel portion extending perpendicular to said line to assist in defining said spaced bend zones.

11. The construction defined in claim 9 in which spaced bend score lines are formed in the panel portion extending perpendicular to said line to assist with said lobes in defining said spaced bend zones.

12. The construction defined in claim 1 in which angled control beads are formed in the panel portion adjacent said rivet means to assist in defining the spaced bend zones.

13. The construction defined in claim 12 in which the embossed groove has spaced lobes adjacent the rivet means, in which the lobes are located one on either side of said line, and in which the spaced lobes assist said angled beads in defining the bend zone inside the rivet means.

14. The construction defined in claim 1 in which the offset nose tip is spaced above the wall adjacent the main score line.

15. The construction defined in claim 1 in which a triple fold formation is provided in the wall extending from said main score line, in which said triple fold provides a protective bead on said panel portion when the panel portion is severed from the end member, and in which the offset nose tip contacts the triple fold formation adjacent the main score line.

* * * * *